US008404312B2

(12) United States Patent
Nowak et al.

(10) Patent No.: US 8,404,312 B2
(45) Date of Patent: Mar. 26, 2013

(54) METHOD AND SYSTEM FOR EDGE-COATING WOOD SUBSTRATES

(75) Inventors: David H. Nowak, High Point, NC (US); Shaobing Wu, Jamestown, NC (US); Stephen M. LaFrance, Greensboro, NC (US); Lawrence J. Kauppila, Orangeburg, NC (US)

(73) Assignee: Valspar Sourcing, Inc., Minneapolis, MN (US)

( * ) Notice: Subject to any disclaimer, the term of this patent is extended or adjusted under 35 U.S.C. 154(b) by 978 days.

(21) Appl. No.: 11/770,334

(22) Filed: Jun. 28, 2007

(65) Prior Publication Data

US 2008/0041003 A1 Feb. 21, 2008

Related U.S. Application Data

(60) Provisional application No. 60/817,577, filed on Jun. 28, 2006, provisional application No. 60/917,260, filed on May 10, 2007.

(51) Int. Cl.
*B05D 3/02* (2006.01)
*B05D 5/00* (2006.01)

(52) U.S. Cl. ..... 427/393.4; 427/400

(58) Field of Classification Search ..... 427/303, 427/470, 472, 397, 408, 277, 393.4, 400; 428/500, 192, 454

See application file for complete search history.

(56) References Cited

U.S. PATENT DOCUMENTS

| | | | | |
|---|---|---|---|---|
| 3,308,013 | A | | 3/1967 | Bryant |
| 3,900,620 | A | | 8/1975 | Gilman et al. |
| 4,016,312 | A | | 4/1977 | Luthardt |
| 4,117,199 | A | * | 9/1978 | Gotoh et al. ..... 428/486 |
| 4,161,566 | A | | 7/1979 | Higgins |
| 4,218,516 | A | | 8/1980 | Meyer et al. |
| 4,301,217 | A | * | 11/1981 | Rohringer et al. ..... 428/528 |
| 4,541,931 | A | | 9/1985 | Geke et al. |
| 4,600,598 | A | | 7/1986 | Nelson et al. |
| 4,699,730 | A | | 10/1987 | Miles et al. |
| 4,897,291 | A | | 1/1990 | Kim |
| 4,933,091 | A | | 6/1990 | Geke et al. |
| 5,051,283 | A | | 9/1991 | Beane et al. |
| 5,130,184 | A | * | 7/1992 | Ellis ..... 442/295 |
| 5,162,413 | A | | 11/1992 | Kissel |
| 5,202,375 | A | | 4/1993 | Biale |
| 5,270,373 | A | | 12/1993 | Wiercinski et al. |
| 5,374,691 | A | | 12/1994 | Hintze-Bruning et al. |
| 5,400,971 | A | * | 3/1995 | Maugans et al. ..... 239/416.1 |
| 5,512,323 | A | | 4/1996 | Beane et al. |
| 5,529,811 | A | | 6/1996 | Sinko |
| 5,639,027 | A | | 6/1997 | Fritz |

(Continued)

FOREIGN PATENT DOCUMENTS

| | | |
|---|---|---|
| CA | 2 599 431 | 8/2007 |
| GB | 1 113 810 | 5/1969 |

(Continued)

OTHER PUBLICATIONS

International Search Report for PCT/US2007/072348.

(Continued)

*Primary Examiner* — Binh X Tran
*Assistant Examiner* — Mahmoud Dahimene
(74) *Attorney, Agent, or Firm* — IPLM Group, P.A.

(57) ABSTRACT

Engineered wood product edges are protected by applying a two part edge sealing composition to at least one edge surface. The two part edge sealing composition can improve holdout, hide, and water resistance. An edge sealing system and substrates coated with the sealing system are provided.

28 Claims, 4 Drawing Sheets

U.S. PATENT DOCUMENTS

| | | | | |
|---|---|---|---|---|
| 5,944,938 | A * | 8/1999 | Winterowd et al. | 156/315 |
| 5,993,534 | A | 11/1999 | Wintercrowd et al. | |
| 6,180,172 | B1 | 1/2001 | Hasenkamp et al. | |
| 6,264,113 | B1 | 7/2001 | Dingler | |
| 6,468,632 | B2 | 10/2002 | Winkowski | |
| 6,533,856 | B1 | 3/2003 | Hodges et al. | |
| 6,548,109 | B1 | 4/2003 | Hagquist et al. | |
| 6,558,748 | B2 | 5/2003 | Ou et al. | |
| 6,602,582 | B2 | 8/2003 | Wintercrowd | |
| 6,608,131 | B1 | 8/2003 | Winterowd et al. | |
| 6,794,475 | B1 | 9/2004 | Bialke et al. | |
| 6,803,091 | B2 | 10/2004 | Wintercrowd et al. | |
| 2002/0155279 | A1 | 10/2002 | Dai et al. | |
| 2003/0008110 | A1 | 1/2003 | Hsu | |
| 2003/0049451 | A1 | 3/2003 | Stay | |
| 2003/0127205 | A1 * | 7/2003 | Odberg et al. | 162/135 |
| 2004/0142192 | A1 | 7/2004 | Hosotte et al. | |
| 2005/0269728 | A1 | 12/2005 | Roos | |
| 2006/0019568 | A1 | 1/2006 | Toas et al. | |
| 2006/0093745 | A1 * | 5/2006 | Nicholson et al. | 427/393 |
| 2006/0263618 | A1 | 11/2006 | Gardner et al. | |
| 2007/0244014 | A1 * | 10/2007 | Weaver et al. | 507/215 |
| 2008/0246177 | A1 * | 10/2008 | Baus et al. | 264/128 |

FOREIGN PATENT DOCUMENTS

| | | |
|---|---|---|
| GB | 1 484 653 | 9/1977 |
| GB | 1 489 814 | 10/1977 |
| GB | 1 562 016 | 3/1980 |
| WO | WO 2006/092330 A1 | 9/2006 |

OTHER PUBLICATIONS

Koleske et al., Paint and Coatings Industry, Apr. 2003, pp. 12-86.

* cited by examiner

METHOD AND SYSTEM FOR EDGE-COATING WOOD SUBSTRATES

CROSS-REFERENCE TO RELATED APPLICATION

This application claims priority from U.S. Provisional Application Ser. No. 60/817,577, filed Jun. 28, 2006, and from U.S. Provisional Application Ser. No. 60/917,260, filed May 10, 2007, the disclosures of which are incorporated herein by reference.

TECHNICAL FIELD

This invention is related to a process useful in the manufacturing of engineered wood products such as oriented strand board (OSB) panels with improved swell resistance and product appearance.

BACKGROUND

Engineered wood products such as oriented strand board, fiberboard, and laminated veneer lumber (LVL), are widely used in residential and commercial construction, and are gaining popularity in markets such as materials handling and the manufacturing of upholstered furniture. These products are available in a variety of forms such as oriented strand board panels, medium density fiberboard (MDF), laminated veneer lumber products, and the like.

Engineered wood products are typically manufactured from small pieces of wood and heat-cured adhesives. Oriented strand board panels are manufactured from heat-cured adhesives and rectangular-shaped wood strands that are arranged in cross-oriented layers. These are commonly referred to as engineered structural panels and have uses that include roof sheathing, wall sheathing, and flooring systems for residential home construction. The manufacturing process makes it possible for panel makers to add innovative features such as a slip-resistant texture to panels designed for roof sheathing, or to supply oversized and metric panels.

Exposure to water can cause engineered wood products such as OSB panels, to undergo irreversible thickness swelling. The worst swelling behavior typically observed is on the edges of the panel. Engineered wood panels tend to swell to a greater extent on the exposed edges than in the center. For example, OSB sheets manufactured at a thickness of 720 mils (0.720 inch, 1.829 cm), can actually swell to edge thickness values in excess of 1000 mils (1 inch, 2.54 cm). After drying, these sheets do not recover to their original thickness and instead dry to a swollen edge thickness of about 900 mils.

There are available solutions to the problem of edge swell. Most manufacturers of engineered wood products such as OSB sheets attempt to improve the dimensional stability of the sheet by applying a sealing composition such as a paint-formulation to all four edges of the OSB sheet. Typically, the sealer dries into a hydrophobic film, which binds to the OSB sheet and inhibits the absorption of water into the edge of the sheet. Thus, the edge sealant can help to reduce the degree of edge swell experienced by the sheet when it is exposed to water.

Edge sealants are generally applied to engineered wood products such as OSB sheets at the point of manufacture. It is common for a liquid sealant formulation to be applied to the sheets shortly after manufacture. Typically, the formulation dries rapidly after application to the sheets without the use of heating or ventilation equipment. The application of sealers is considered to be an industry standard which provides esthetic value for general marketing purposes and performance advantages to help protect the water-sensitive panels from moisture and rain during the construction phase of a home.

Most sealant formulations are colored and are applied at a level that imparts a solid, uniform, attractive appearance to the engineered wood product unit. After a sealer is applied to the edges of an engineered wood product and dried it should reduce the thickness swelling that typically occurs if the product is exposed to water. Thus, the sealer should dry to form a film that bonds to the wood product and is relatively elastic so that it can expand and stretch as the wood product swells.

There is a need for improving the methods for protecting engineered wood products, particularly the surfaces and edges of substrates which can be exposed to the elements, e.g., water during transportation to customers.

SUMMARY

The present invention provides a method for protecting the edges of engineered wood products. The method includes the step of applying a two part edge sealing composition having a first part comprising a coagulating agent and a second part comprising an aqueous edge sealing composition to at least one edge of the substrate (article). In one embodiment, the first part and second part can be applied in succession to the substrate. The method provides improved swell resistance and improvement in the durability and dimensional stability of the edges of engineered wood products when exposed to water. The invention can also provide superior holdout and provide a more uniform appearance over inconsistent and porous engineered wood product surfaces. The method can provide a film that is tack-free and non-adhesive.

In another embodiment, the first part and the second part are mixed in-flight, prior to contacting the substrate, or mixed immediately upon contacting the substrate. Mixing of the two part system before contact with the substrate allows for a reduction of the amount of edge sealing composition typically required. The method can provide a film that is tack-free and non-adhesive.

In another embodiment, the invention provides an edge sealing system for an engineered wood substrate where the sealing system includes a two part edge sealing composition for coating the edges of engineered wood products. The edge sealing system includes a first part having a coagulating agent and a second part having an aqueous edge sealing composition. The edge sealing system can be applied as described above and provide a film that is tack-free and non-adhesive.

In another embodiment, a two part edge sealing system applied using in flight mixing, prior to contacting the substrate, can increase the efficiency and enhance the performance of the edge sealing composition. The two part edge sealing system can provide a film that is tack-free and non-adhesive.

In another embodiment, the invention provides articles, wherein the article is prepared from an engineered wood product and has the two-part edge sealing system applied to at least one edge of the substrate. The two-part edge sealing system includes a first part comprising a coagulating agent and a second part having an aqueous edge sealing composition. The edge sealing system includes one or more coating compositions applied to at least one edge of the article.

The above summary of the present invention is not intended to describe each disclosed embodiment or every implementation of the present invention. Other features, objects, and advantages of the invention will be apparent from the description and drawings, and from the claims. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

The details of one or more embodiments of the invention are set forth in the accompanying drawing and the description below. Other features, objects, and advantages of the invention will be apparent from the description and drawings, and from the claims.

DETAILED DESCRIPTION

Figure 1:
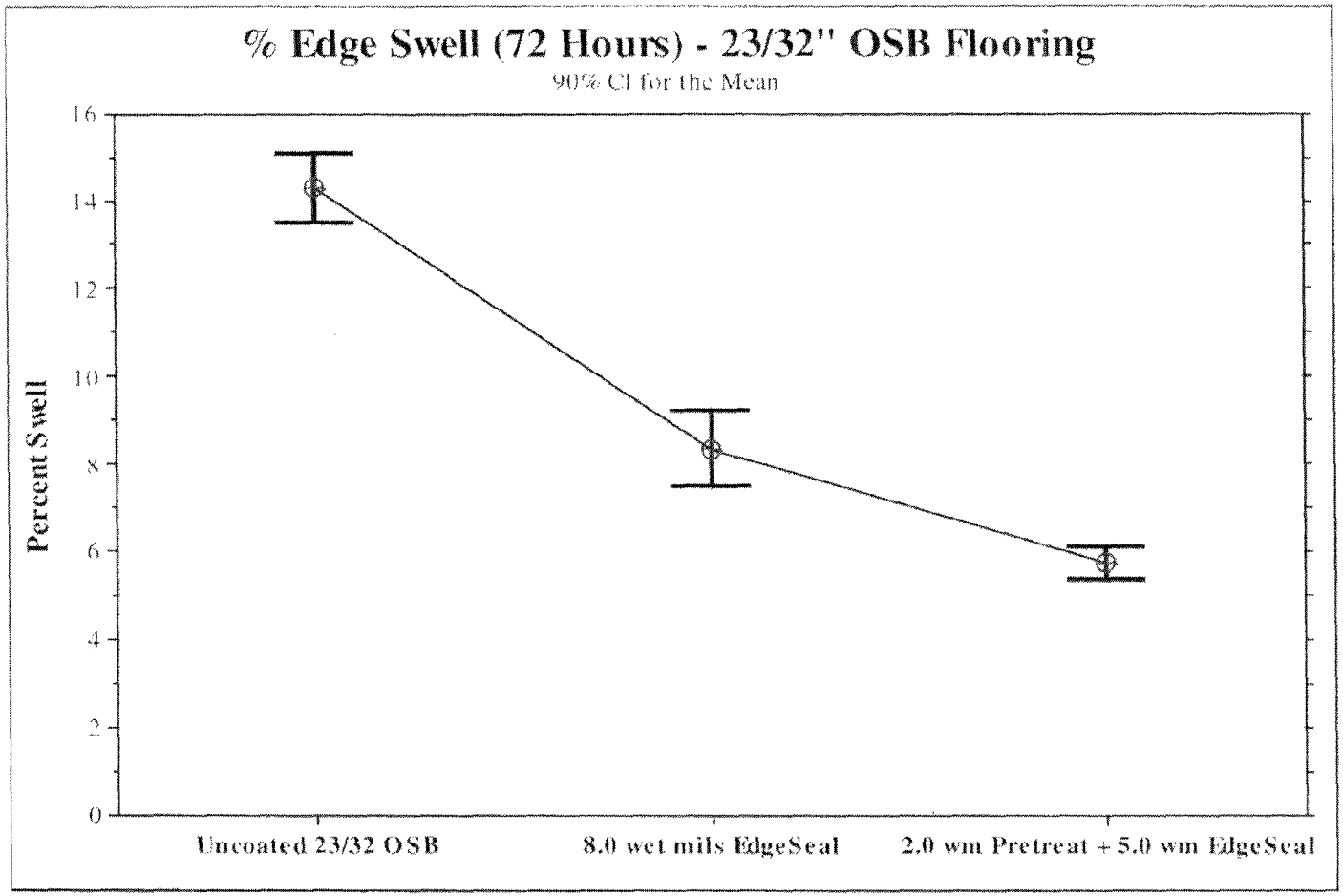
FIG. 1 illustrates the improvement in edge swell for an edge coated 23/32 in. OSB sheet when the first part and second part are applied at various thicknesses to an edge surface of the sheet.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

The terms "a," "an," "the," "at least one," and "one or more" are used interchangeably. Thus, for example, a coating composition that comprises "an" amine can be interpreted to mean that the coating composition includes "one or more" amines.

The terms "latex polymer resin", "latex resin" "latex emulsion" or "latex", refer to a dispersion of polymer particles in water and are used interchangeably. Latex polymer resins typically include one or more dispersing agents (for example, a surfactant) for creating a dispersion or emulsion of polymer particles in water.

The recitation of numerical ranges by endpoints includes all numbers subsumed within that range (e g., 1 to 5 includes 1, 1.5, 2, 2.75, 3, 3.80, 4, 5, etc.).

The present invention provides a method for protecting the edges of engineered wood products wherein the method includes the step of applying a two part edge coating composition to at least one edge of a substrate where the first part includes a coagulating agent and the second part includes an aqueous edge sealing composition. In another embodiment the first part can include a filler.

The present invention also provides an edge sealing system for a substrate such as an engineered wood product. The sealing system preferably includes a first part having a coagulating agent and a second part having an aqueous edge sealing composition. The sealing system includes one or more layers of the two part edge sealing composition applied to at least one edge of the substrate. When more than one layer is applied, each coating composition (layer) can be the same or different. The disclosed sealing system is particularly suitable for coating the edges of engineered wood substrates such as OSB.

While not intending to be bound by theory, the first part of the two part sealing system may enhance the performance of the edge sealing composition by retarding the absorption of the edge sealing composition into the wood fibers or enhancing the coagulation of the edge sealing composition on the surface of the substrate, to help minimize penetration of the coating composition into the substrate. By minimizing the penetration of the coating composition into the porous wood fibers, a more continuous dry film is achieved which provides a more uniform appearance, and enhanced hide. When used on the edges of an engineered wood substrate, e.g., OSB sheets, superior edge swell resistance is observed.

In one embodiment, the first part of the composition includes a coagulating or flocculating agent. The terms "coagulating agent," "coagulant," or "coagulation agent," "flocculating agent," "flocculant," or "flocculation agent" are used interchangeably, and include substances that can serve to unite molecules or dispersed particles to coagulate or form flocs. Examples of coagulating agents include, but are not limited to, sulphates, chlorides, phosphates and carbonates (magnesium sulphate, aluminum sulphate, ammonium aluminum sulphate, iron sulphate, calcium sulphate, ferrous sulphate, ferric sulphate, zinc sulphate, aluminum chloride, $Al(OH)Cl_2$, magnesium chloride, iron chloride, calcium chloride, stannous chloride, stannic chloride, zinc chloride, ferrous chloride, ferric chloride, zinc ammonium carbonate, aluminum carbonate, aluminum phosphate, zinc phosphate, ferrous phosphate, esters such as phosphate esters, and the like); acids such as sulphuric, hydrochloric, phosphoric, acetic, citric, p-toluene sulfonic acid (PTSA), and the like; polyquaternary amine, alkylamine-epichlorohydrin, polyacryamide, etc. Exemplary commercial coagulating products of those agents are MARFLOC™ 5242, MARFLOC 2150, MILFLOC V-27, ALUM, TRAMFLOC 860-899, TRAMFLOC 100, TRAMFLOC 29, TRAMFLOC 540-559, TRAMFLOC 540-560, CRODAZOLINE "O", ZELEC "UN", ARQUAD T-50 and the like. A preferred group of coagulating agents includes the coagulating agent comprises magnesium sulphate, aluminum sulphate, ammonium aluminum sulphate, aluminum chloride, magnesium chloride, calcium sulphate, calcium chloride, or mixture thereof. The most preferred coagulating agent is aluminum sulfate.

The amount of coagulating agent in the first part of the two part edge sealing composition may be from about 1 to about 60% by weight, preferably from about 2 to about 35% by weight, and more preferably from about 2 to about 10% by weight, based on the total weight of the components in the two part sealing composition.

In another embodiment, the first part of the sealing composition preferably further includes a filler. The filler may extend, lower the cost of, or provide desirable characteristics to a composition before and after curing. Non-limiting examples of fillers include, for example, clay, glass beads, calcium carbonate, talc, silicas, organic fillers, and the like.

Edge sealing compositions may include, for example, water, an aqueous dispersion of one or more waxes, and an aqueous polymer resin. The polymer resins can include latex resins. Non-limiting examples of coating compositions are disclosed in U.S. Pat. Nos. 6,608,131 and 4,897,291. Non-limiting examples of commercial aqueous coating compositions for coating edges of substrates such as OSB, include ULTRA SEAL™ or EDGE SEAL™ from The Valspar Corporation; CBS™ or WIL-SEAL™ composite board sealers available from Willamette Valley Company.

The edge sealing compositions may include a wax emulsion and a polymer resin. Exemplary wax emulsions include from about 20% by weight wax solids to about 90% by weight wax solids based on the total weight of the first part of the edge sealing composition. Preferably, the compositions have from about 40% by weight wax solids to about 80% by weight wax solids. More preferably, the compositions have about 60% by weight wax solids to about 80% by weight wax solids.

The polymer resin in the edge sealing composition is substantially free of reactive olefinic groups. A polymer resin is substantially free of reactive olefinic groups when at least 95% of the olefinic monomers that form the polymer resin are reacted (no more than 5% unreacted monomer remains), preferably at least 97% of the olefinic monomers are reacted (no more than 3% unreacted monomer remains), and more preferably at least 99% of the olefinic monomers are reacted (no more than 1% unreacted monomer remains).

Exemplary latex polymer resins include polyurethanes, polyamides, chlorinated polyolefins, acrylics, vinyls, oil-modified polymers, polyesters, and mixtures or copolymers thereof. Non-limiting examples of latex resins include vinyl resins such as acrylic resins, styrene-butadiene rubber resins, vinyl halide resins, acetate resins, and the like or mixtures thereof. Latex polymers can be prepared through chain-growth polymerization, using one or more olefinic monomers.

Substrates or articles that can be coated using the disclosed method include engineered wood substrates that have edges that may be exposed to the elements. The term "engineered wood products" generally refer to products or substrates that are prepared from any wood pieces such as sheets, chips, flakes, fibers, strands (e.g., rectangular-shaped wood strands), saw dust, and the like. The pieces are typically bonded together, often with an adhesive. Non-limiting examples of engineered wood products include oriented strand board (OSB), fiberboard, laminated veneer lumber products such as plywood, doorskins, and the like.

The term "fiberboard" refers to a type of engineered wood product that is made out of wood fibers. Typically, fiberboard is a building material composed of wood chips or plant fibers bonded together and compressed into rigid sheets. Types of fiberboard in order of increasing density include particle board, medium-density fiberboard and hardboard, sometimes referred to as high-density fiberboard. Fiberboard is sometimes used as a synonym for particle board. However, particle board typically refers to low-density fiberboard. Fiberboard, particularly medium-density fiberboard, is heavily used in the furniture industry. For pieces that will be visible, a veneer of wood can be glued onto fiberboard to give it the appearance of conventional wood.

The substrates are coated on one or more edge surfaces with a two part edge sealing system. The sealing system includes a first part having a coagulating agent and a second part having an aqueous edge sealing composition. The sealing system may be applied in one or more layers.

The two part edge sealing composition can provide improved hide and holdout. The term "hide" refers to the ability of the coating composition to cover or color uniformly and hide any variations in the color of the coated surface of the substrate. A sealing system having "good" hide will typically require a thinner coating to provide an acceptable uniform appearance on the finished substrate. The term "holdout" refers to the ability of the coating to resist excessive penetration into the pores on the surface of the substrate that is coated. A coating system having good holdout will not require large amounts of coating composition to provide an acceptable uniform appearance on the finished substrate. The disclosed method can reduce the amount of edge sealing composition typically required to achieve good hide and holdout.

The disclosed edge coating method and sealing systems may have improved, e.g., lower, volatile organic content (VOC). Preferred edge coating systems have a VOC of less than about 5%, more preferably less than about 2% and most preferably less than about 0.5%, based on the total weight of the two part edge sealing composition.

The edge sealing composition can be applied as a single coating layer or as multiple layers using one or more than one edge coating compositions (e.g., a first layer having one edge sealing composition and a second layer having a different edge sealing composition). The specific application and order of application of the selected edge sealing compositions can be readily determined by a person skilled in the art of preparing or applying such compositions. Exemplary descriptions of these aqueous based coating systems are described above. Accordingly, the substrates can be prepared by applying the two part edge sealing composition in a single application (layer) or the two part edge sealing compositions can be applied in multiple layers. The edge sealing composition(s) are preferably applied at about 5 to 65% solids by weight, more preferably at about 20 to 55% solids, and most preferably at about 35 to 50% solids. Preferred edge sealing composition(s) contain less than 5% volatile organic compounds, more preferably, a VOC of less than about 2%, and most preferably a VOC is less than 0.5%, based on the total weight of the coating system.

The two part edge sealing composition is preferably applied by any number of application techniques known in the art, including but not limited to brushing, brush coater, direct roll coater, reverse roll coater, flood coater, vacuum coater, curtain coater or various spraying techniques. Exemplary spraying techniques include, e.g., two gun, dual nozzles, single gun with multiple spray nozzles and the like. The two parts can be applied using a single applicator that can apply the two parts independently (e.g., the two parts do not mix within the applicator) or the two parts can be applied simultaneously from separate spraying units, e.g., separate spray guns. Non-limiting examples of single applicators include a Binks Mach 1 PCX Plural Component paint sprayer, spray guns disclosed in U.S. Pat. Nos. 6,264,113, 5,639,027, 5,400,971 or the like. The various techniques each offer a unique set of advantages and disadvantages depending upon the substrate profile, morphology and tolerable application efficiencies.

The film thickness can be controlled by application rate. The dry film thickness (DFT) of the edge sealing composition on engineered wood substrates may be in the range of, for example, about 1 to about 10 mils (0.0025 to 0.025 cm), more preferably about 2 to about 8 mil (0.0051 to 0.0203 cm), and most preferably about 2 to about 6 mil (0.0051 to 0.015 cm).

Exemplary wet film thicknesses of the two part edge sealing composition on engineered wood substrates are in the range of, for example, about 2 to about 20 mils, more preferably about 4 to about 15 mils, and most preferably about 4 to about 8 mils.

It is preferred that the substrates are coated on at least one edge with the disclosed sealing system. More preferably, the substrates of the invention are coated on four edges. In addition, a topcoat may be applied directly to the disclosed sealing system.

Exemplary optional pigments for use in the disclosed edge sealing compositions include, for example, titanium dioxide white, carbon black, lampblack, black iron oxide, red iron oxide, yellow iron oxide, brown iron oxide (a blend of red and yellow oxide with black), phthalocyanine green, phthalocyanine blue, organic reds (such as naphthol red, quinacridone red and toulidine red), quinacridone magenta, quinacridone violet, DNA orange, or organic yellows (such as Hansa yellow). The composition can also include a gloss control additive or a commercially available optical brightener such as UVITEX OB from Ciba-Geigy.

The edge sealing compositions can also include a filler. Exemplary optional fillers and inert ingredients for use in the disclosed coating compositions include, for example, clay, glass beads, calcium carbonate, talc, silicas, organic fillers, and the like.

The disclosed edge sealing compositions may also include other ingredients that modify properties of the composition as they are stored, handled, or applied, and at other or subsequent stages. Additional optional components or additives for use in the edge sealing compositions include surface active agents (surfactants), pigments, colorants, dyes, fillers, sedimentation inhibitors, ultra-violet-light absorbers, optical brighteners, thickeners, heat stabilizers, leveling agents, anti-cratering agents, curing indicators, plasticizers, biocides, mildewcides, surfactants, dispersants, defoamers, and the like. Flatting agents, mar and abrasion additives and other similar performance enhancing additives may be employed as required in amounts effective to upgrade or otherwise alter the performance of the cured coating and the coating composition. Desirable performance characteristics of the coating include chemical resistance, abrasion resistance, hardness, gloss, reflectivity, appearance, or combinations of these characteristics, and other similar characteristics. Non-limiting examples of exemplary additives for use with the disclosed edge sealing compositions are described in Koleske et al., Paint and Coatings Industry, April, 2003, pages 12-86.

The invention will be described by the following non-limiting examples.

EXAMPLES

Example 1

General Edge Swell Test Procedure

Test panels are prepared by cutting an OSB sheet to test panels 12" long and 4" wide using a sharp saw blade. The test panels are bundled together into a stack and placed in a 150° F. oven for two hours prior to application of the edge seal.

Each coating material (pre-treatment and coating composition) is loaded into a separate Kremlin airless spray pump with a fluid pressure of 600 psi. For each coating material, a single 1229 spray tip with a 0.033 restrictor (Spray Systems Co.) is installed approximately 5 inches from the edge surface of the OSB samples. The pre-treatment solution is prepared with 49.7 g/l of ammonium aluminum sulphate in water and is applied by spraying the edges of the bundle prior to the application of the coating composition. The coating composition applied consists of 40% solids by weight of an anionic aqueous wax dispersion and a styrene-acrylate latex polymer.

The samples are removed from the oven and "stack" sprayed on the airless spray conveyor set-up. The pre-treatment is applied and immediately followed by application of the coating composition. The edges are allowed to dry or harden for at least 24 hours at ambient temperature.

Figure 4:
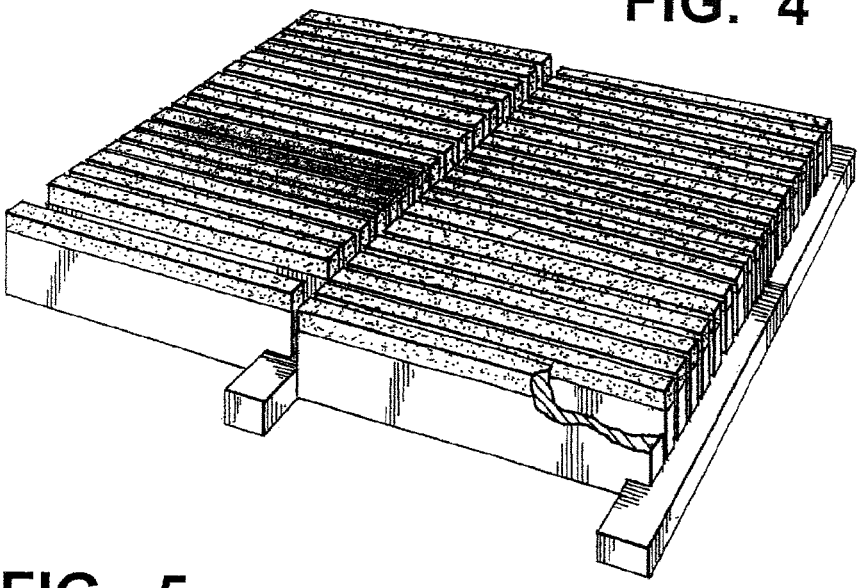
FIG. 4 shows an "Apron," a hydrophobic coating composition applied adjacent to the test edge surfaces around the perimeter of the test panels.

After drying, the test panels are separated and the edges are protected by application of an "Apron," a 1-inch strip of a hydrophobic coating composition applied with a brush adjacent to the test edge surfaces around the entire perimeter to prevent water from penetrating the non-test surfaces. The test panels are then equilibrated for three days before beginning the soak tests. (See FIG. 4.)

The thickness measurements are obtained using a Mitutoyo DIGIMATIC™ indicator mounted to a gage stand and fitted to a test jig. Thickness measurements are taken at one inch intervals starting one and one half inches from the ends of the test panels. This provides about nine (9) measurements for each panel. The measurements are averaged to provide a thickness value for each sample.

Figure 5:
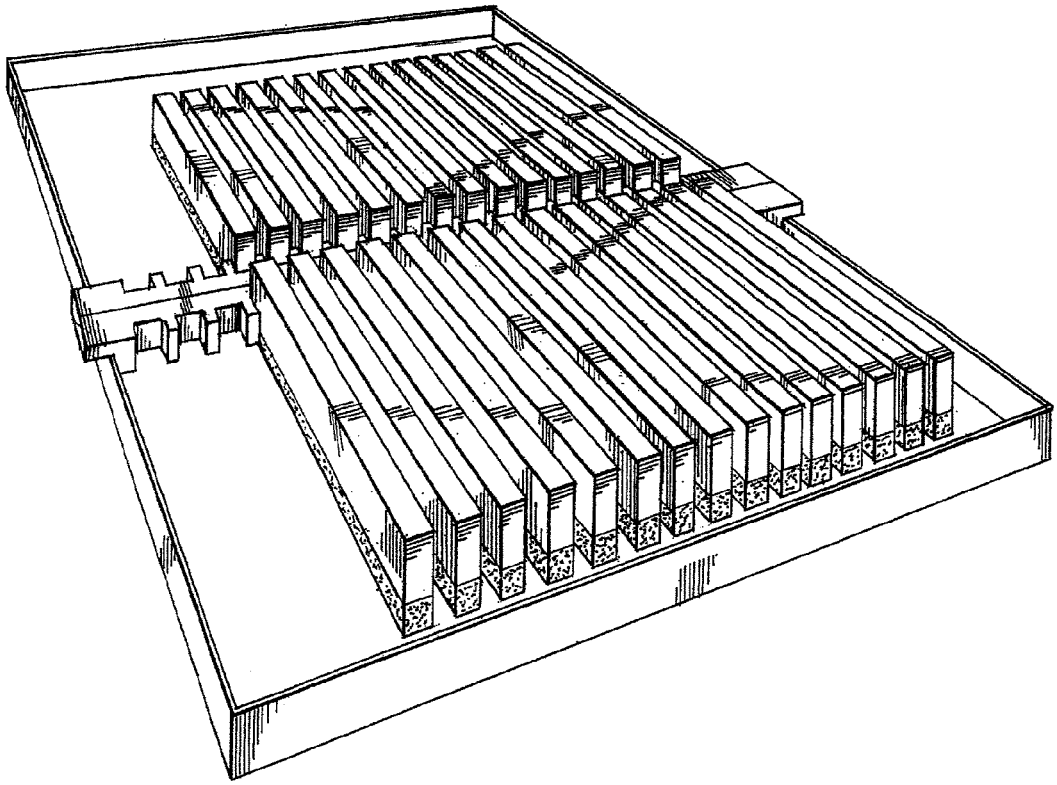
FIG. 5 shows the test panels placed in a large edge soak tank during the edge swell test.

Once the initial measurements are complete, all the samples are placed in a large edge soak tank. (See FIG. 5.) A 2-inch thick piece of upholstery foam (Item#000853440 from Hancock Fabrics) is placed under the test panels in the soak bath. The tap water in each tank is maintained at a level ⅛" below the surface of the polyethylene or equivalent foam by refilling the bath at least once per day during the evaluation period.

Figure 2:
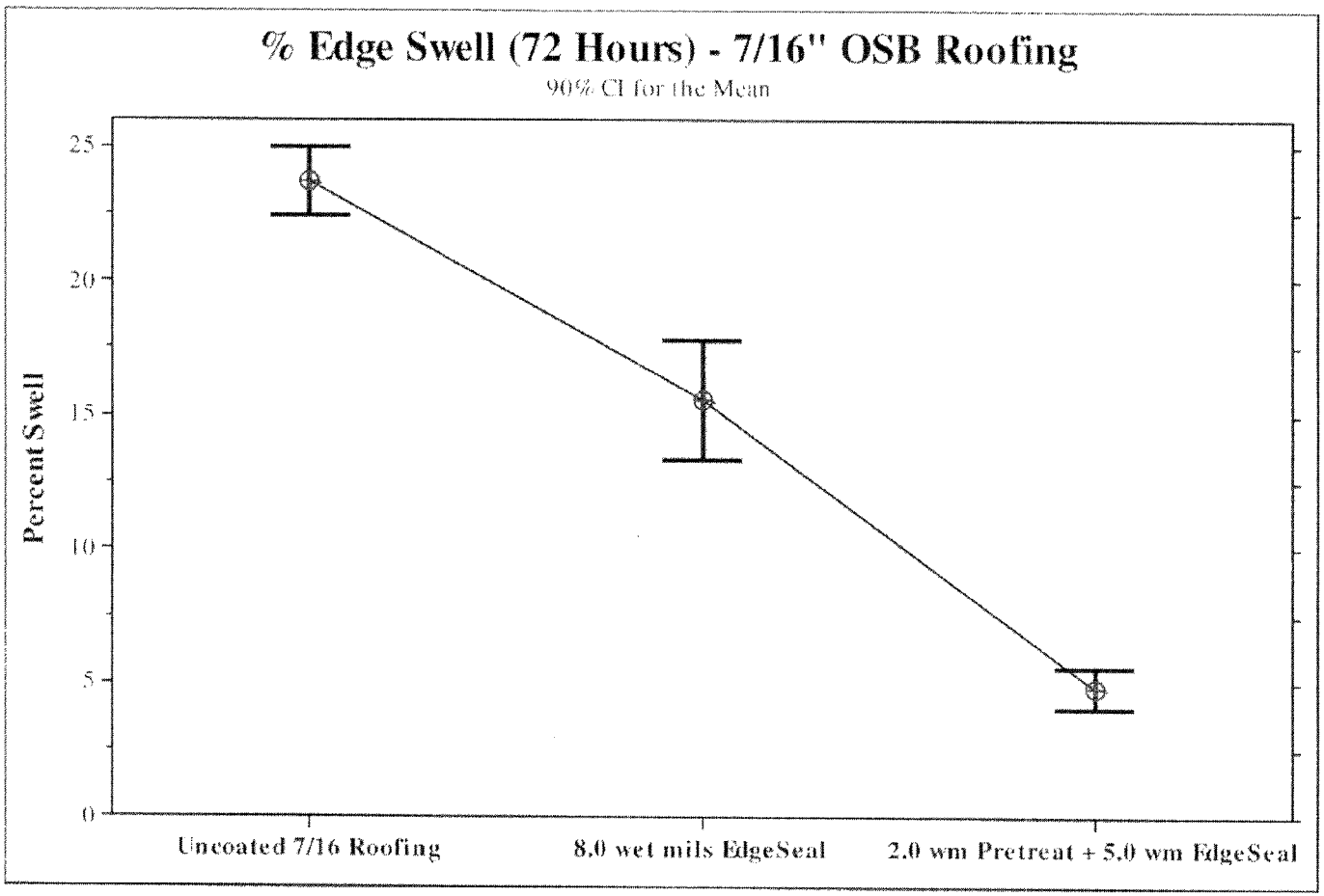
FIG. 2 illustrates the improvement in edge swell for an edge coated 7/16 in. OSB sheet when the first part and second part are applied at various thicknesses to an edge surface of the sheet.
Figure 3:
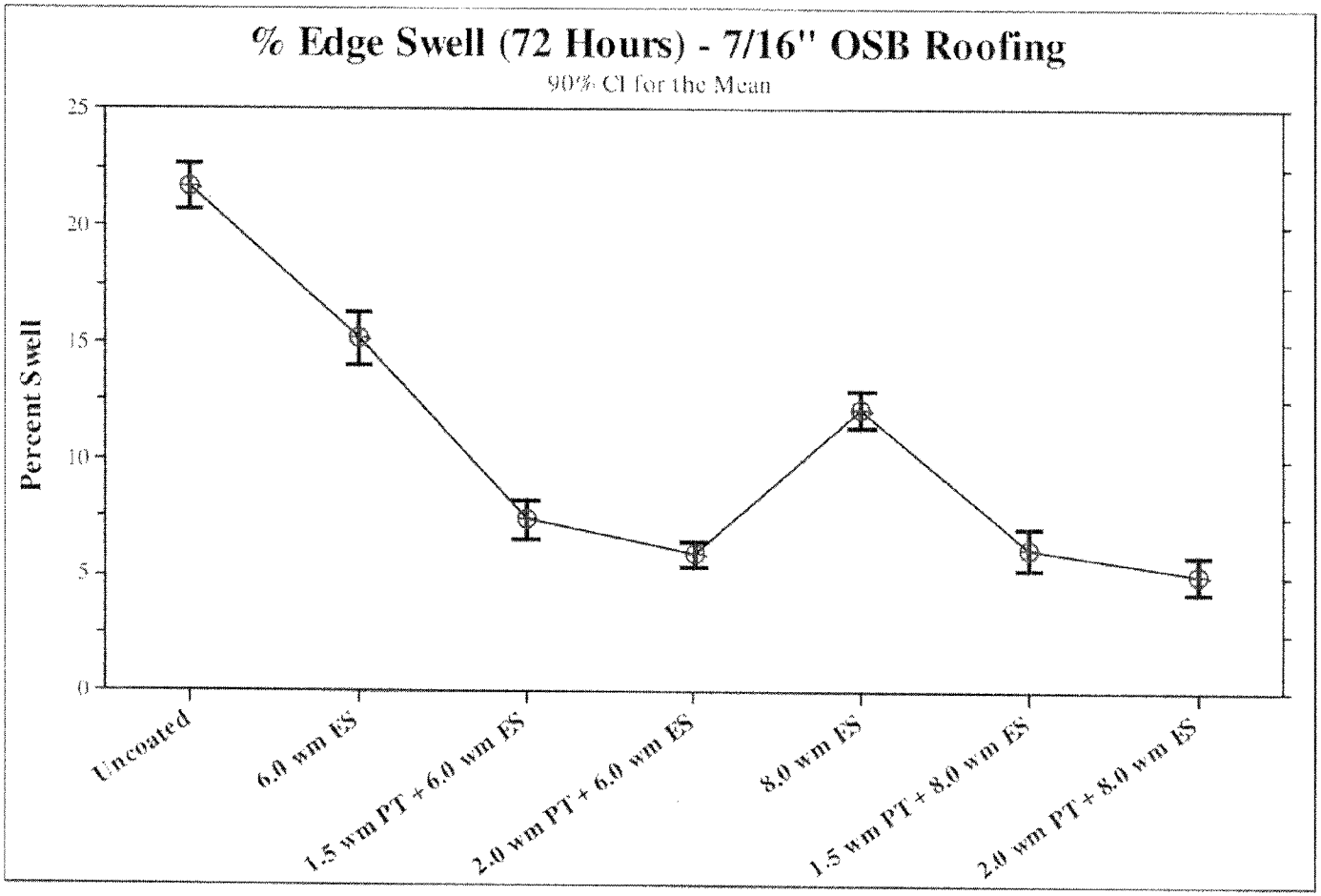
FIG. 3 illustrates the improvement in edge swell for an edge coated 7/16 in. OSB sheet when the first part and second part are applied at various thicknesses to an edge surface of the sheet.

The test panels are removed and measurements are taken after 72-hour intervals for tracking and evaluation purposes. Percent swell for each test set is determined by subtracting the average final thickness from the average initial thickness then dividing by the average initial thickness. Percent efficiency for each test set is determined by subtracting the test set's average swell value from the uncoated OSB swell value then dividing by the uncoated OSB swell value. The results are illustrated in FIGS. 1, 2 and 3.

Example 2

Application of Edge Seal on 23/32 OSB

A series of test panels (3 sets of 12) 23/32 in thick is prepared as described in Example 1. The first group of test panels is uncoated. The second group of test panels is coated with an edge sealing composition alone, 8 wet mils. The third group of test panels is coated with the pre-treatment composition, 2 wet mils, followed by an edge sealing composition, 5 wet mils. After drying, an apron was applied adjacent to the test surface. The test panels are measured for thickness. After measuring, the test panels are placed in the soak tank for 72-hours. After the test period the test panels are re-measured. The results are illustrated in FIG. 1 and Table 1.

TABLE 1

Edge Swell Evaluation of 23/32" OSB

| Edge Seal Application | Pre-treatment Application | Sample Size (n) | Avg. % Edge Swell 72 Hours | Percent Efficiency |
|---|---|---|---|---|
| Uncoated control | None | 12 | 15.3 | — |
| 8.0 wet mils | None | 12 | 12.6 | 17.70% |
| 5.0 wet mils | 2.0 wet mils | 12 | 5.6 | 63.40% |

Example 3

Application of Edge Seal on 7/16 OSB

A series of test panels (3 sets of 12) 7/16 in thick is prepared as described in Example 1. The first group of test panels is uncoated. The second group of test panels is coated with an edge sealing composition alone, 8 wet mils. The third group of test panels is coated with the pre-treatment composition, 2 wet mils, followed by an edge sealing composition, 5 wet mils. After drying, an apron was applied adjacent to the test surface. The test panels are measured for thickness. After measuring, the test panels are placed in the soak tank for 72-hours. After the test period the test panels are re-measured. The results are illustrated in FIG. 2 and Table 2.

TABLE 2

Edge Swell Evaluation of 7/16" OSB

| Edge Seal Application | Pre-treatment Application | Sample Size (n) | Avg. % Edge Swell 72 Hours | Percent Efficiency |
|---|---|---|---|---|
| Uncoated control | None | 12 | 21.2 | — |
| 8.0 wet mils | None | 12 | 12.7 | 40.10% |
| 5.0 wet mils | 2.0 wet mils | 12 | 4.1 | 80.70% |

Example 4

Application of Edge Seal on 7/16 OSB

A series of test panels (7 sets of 12) 7/16 in thick is prepared as described in Example 1. The first group of test panels is uncoated. The second group of test panels is coated with an edge sealing composition alone, 6 wet mils. The third group of test panels is coated with the pre-treatment composition, 1.5 wet mils, followed by an edge sealing composition, 6 wet mils. The fourth group of test panels is coated with the pre-treatment composition, 2 wet mils, followed by an edge sealing composition, 6 wet mils. The fifth group of test panels is coated with an edge sealing composition alone, 8 wet mils. The sixth group of test panels is coated with the pre-treatment composition, 1.5 wet mils, followed by an edge sealing composition, 8 wet mils. The seventh group of test panels is coated with the pre-treatment composition, 2 wet mils, followed by an edge sealing composition, 8 wet mils. After drying, an apron was applied adjacent to the test surface. The test panels are measured for thickness. After measuring, the test panels are placed in the soak tank for 72-hours. After the test period the test panels are re-measured. The results are illustrated in FIG. 3 and Table 3.

TABLE 3

Edge Swell Evaluation of 7/16" OSB

| Edge Seal Application | Pre-treatment Application | Sample Size (n) | Avg. % Edge Swell 72 Hours | Percent Efficiency |
|---|---|---|---|---|
| Uncoated control | None | 12-January | 21.7 | — |
| 6.0 wet mils | None | 12-February | 15.1 | 30.40% |
| 6.0 wet mils | 1.5 wet mils | 12-March | 7.4 | 65.90% |
| 6.0 wet mils | 2.0 wet mils | 12-April | 5.9 | 72.80% |
| 8.0 wet mils | None | 12-May | 12.1 | 44.20% |
| 8.0 wet mils | 1.5 wet mils | 12-June | 6.1 | 71.90% |
| 8.0 wet mils | 2.0 wet mils | 12-July | 5 | 77.00% |

Example 5

Edge Swell Evaluation of 7/16" OSB with Willamette Valley CBS Sealer

Following the procedure disclosed in Example 3, A series of test panels (7 sets of 12) 7/16 in thick is prepared as described in Example 1. The first group of test panels is uncoated. The second group of test panels is coated with an edge sealing composition alone, 8 wet mils. The third group of test panels is coated with the pre-treatment composition, 1.0 wet mil, followed by an edge sealing composition, 6.5 wet mils. After drying, an apron was applied adjacent to the test surface. The test panels are measured for thickness. After measuring, the test panels are placed in the soak tank for 72-hours. After the test period the test panels are re-measured. The results are tabulated in Table 4.

TABLE 4

Edge Swell Evaluation of 7/16" OSB with Willamette Valley CBS Sealer

| CBS Edge Seal Application | Pre-treatment Application | Sample Size (n) | Avg. % Edge Swell 72 Hours | Percent Efficiency |
|---|---|---|---|---|
| Uncoated control | None | 8 | 11.4 | — |
| 8.0 wet mils | None | 8 | 6.5 | 42.90% |
| 6.5 wet mils | 1.0 wet mil | 8 | 3.9 | 65.70% |

Example 6

Edge Swell Evaluation of 23/32" OSB with Willamette Valley CBS Sealer

Following the procedure disclosed in Example 3, A series of test panels (7 sets of 12) 23/32 in thick is prepared as described in Example 1. The first group of test panels is uncoated. The second group of test panels is coated with an edge sealing composition alone, 8 wet mils. The third group of test panels is coated with the pre-treatment composition, 1.0 wet mil, followed by an edge sealing composition, 6.5 wet mils. After drying, an apron was applied adjacent to the test surface. The test panels are measured for thickness. After measuring, the test panels are placed in the soak tank for 72-hours. After the test period the test panels are re-measured. The results are tabulated in Table 5.

TABLE 5

Edge Swell Evaluation of 23/32" OSB with Willamette Valley CBS Sealer

| CBS Edge Seal Application | Pre-treatment Application | Sample Size (n) | Avg. % Edge Swell 72 Hours | Percent Efficiency |
|---|---|---|---|---|
| Uncoated control | None | 8 | 21.7 | — |
| 8.0 wet mils | None | 8 | 13.1 | 39.60% |
| 6.5 wet mils | 1.0 wet mils | 8 | 7.9 | 63.50% |

Examples 7-10

Coating and General Edge Swell Test Procedure

An aluminum sulphate solution (Part A) with 20 wt % solids is prepared for use as a coagulation agent. A water-borne edge sealing composition (Part B), including a styrene acrylic resin (20 wt %), silicon surface additives (0.5 wt %), wax emulsions (50 wt %), defoamers (0.2 wt %), colorants (2 wt %), pigments (5 wt %), fungicides (0.1 wt %), viscosity control agents (1.8 wt %), water (20.4 wt %), is formulated and used to perform the test.

Test panels are prepared by cutting an OSB sheet into panels 12" long and 4" wide. The test panels are bundled together into a stack and placed in a 150° F. oven for two hours prior to application of the edge seal system.

Each part of the sealer system (Part A, coagulation agent and Part B, edge sealing composition) is loaded into a modified Binks Mach 1 PCX Plural Component paint sprayer. The sprayer is used to apply a blended stream of Part A (fluid pressure 20-60 PSI and air pressure 20-80 PSI) and Part B (a fluid pressure of 60-80 PSI and air pressure 50-60 PSI).

The test panels are removed from the oven and "stack" sprayed on a spray conveyor set-up. The coating weight is controlled at 16 g/ft$^2$ or 3-4 dry mils. Test panels are prepared as follows:

Example 7—control (uncoated);

Example 8—coated with only Part B;

Example 9—coated first with Part A, followed by Part B; and

Example 10—coated with Parts A and B, mixed in-flight. Test samples can be prepared by turning on or turning off Part A or Part B, as required.

Example 7 is a control. Example 8, only Part B (edge sealing composition) is applied. Example 9, Part A is applied as a first step and Part B is applied as a second step. Example 10, Part A and Part B are applied in a single step.

The edge coatings are allowed to dry and harden for at least 24 hours at ambient temperature. After drying, the test panels are separated and the coated edges are protected by application of an "Apron," a 1-inch strip of a hydrophobic coating composition applied with a brush adjacent to the test edge surfaces around the entire perimeter to prevent water from penetrating the non-test surfaces. The test panels are then equilibrated for three days before beginning water soak tests.

The edge swell measurements of the panels are obtained using a Mitutoyo digimatic indicator mounted to a gage stand and fitted to a test jig. Thickness measurements are taken at one inch intervals starting one and one half inches from the ends of the test panels. This provides about nine (9) measurements for each panel. The measurements are averaged to provide a thickness value for each sample.

Once the initial measurements are complete, the samples are placed in a large edge soak tank. A 2-inch thick piece of polyethylene open cell foam is placed under the test panels in the soak bath. The tap water in each tank is maintained at a level ⅛" below the surface of the foam by refilling the bath at least once per day during the evaluation period.

The test panels are removed and measurements are taken after 72-hour intervals for tracking and evaluation purposes. Percent swell for each set of test panels is determined by subtracting the average initial thickness from the average final thickness then dividing by the average initial thickness. Percent efficiency for each test set is determined by subtracting the test set's average swell value from the uncoated OSB swell value then dividing by the uncoated OSB swell value. The results are summarized in Table 6, below.

TABLE 6

Edge Sealant Applications and Testing

| Example | Coating System | Coating weight, g/ft$^2$ | OSB edge swell, % | Water absorption, wt % | Part A Efficiency, % | Appearance |
|---|---|---|---|---|---|---|
| 7 | Control (none) | 0 | 25-30 | 11 | NA | Voids completed exposed |
| 8 | Part B | 16 | 15-20 | 6 | NA | Voids completed exposed |
| 9 | Two Steps Part A and Part B | 12 | 2-5 | 0.5-1.5 | 100% | Majority of the voids are filled and continuous films are observed |
| 10 | One Step Part A and Part B | 12 | 2-5 | 0.5-1.5 | 25-30% of Part A required | Majority of the voids are filled and continuous films are observed |

All patents, patent applications and literature cited in the specification are hereby incorporated by reference in their entirety. In the case of any inconsistencies, the present disclosure, including any definitions therein will prevail. The invention has been described with reference to various specific and preferred embodiments and techniques. However, it should be understood that many variations and modifications may be made while remaining within the invention.

What is claimed is:

1. A method for sealing an outer surface of an engineered wood substrate comprising the steps of:

providing an engineered wood substrate; and applying a two part sealing system having a first part comprising a coagulating agent and a second part comprising an aqueous coating composition comprising a wax emulsion or dispersion and a polymer resin to at least one surface of the substrate;

wherein the first part and second part of the sealing system are applied in succession to the substrate and mixed upon contacting the substrate, or are applied using at least one sprayer and mixed in-flight in a spray stream prior to contacting the substrate, and the sealing system forms a film on the outer substrate surface which resists penetration of the sealing system into the substrate surface and allows for a reduction in the amount of the aqueous coating composition required to reduce swelling when the substrate is exposed to water.

2. The method of claim 1, wherein the first part and the second part are applied in succession to the substrate and mixed upon contacting the substrate.

3. The method of claim 1, wherein the first part and the second part are applied using at least one sprayer and mixed in-flight prior to contacting the substrate.

4. The method of claim 1, wherein the coagulating agent comprises magnesium sulphate, aluminum sulphate, ammonium aluminum sulphate, iron sulphate, calcium sulphate, ferrous sulphate, ferric sulphate, zinc sulphate, aluminum chloride, $Al(OH)Cl_2$, magnesium chloride, iron chloride, calcium chloride, stannous chloride, stannic chloride, zinc chloride, ferrous chloride, ferric chloride, zinc ammonium carbonate, aluminum carbonate, aluminum phosphate, zinc phosphate, ferrous phosphate, phosphate esters, sulphuric, hydrochloric, phosphoric, acetic, citric, p-toluene sulfonic acid or mixture thereof.

5. The method of claim 4, wherein the coagulating agent comprises magnesium sulphate, aluminum sulphate, ammonium aluminum sulphate, aluminum chloride, magnesium chloride, calcium sulphate, calcium chloride, or mixture thereof.

6. The method of claim 5, wherein the coagulating agent comprises aluminum sulphate.

7. The method of claim 4, wherein the coagulating agent is about 1 to about 60% by weight, based on the total weight of the two part sealing system.

8. The method of claim 7, wherein the coagulating agent is about 2 to about 35% by weight, based on the total weight of the two part sealing system.

9. The method of claim 8, wherein the coagulating agent is about 2 to about 10% by weight, based on the total weight of the two part sealing system.

10. The method of claim 1, wherein the coating composition comprises a wax emulsion and a polymer resin.

11. The method of claim 10, wherein the coating composition comprises at least about 20% wax emulsion solids by weight.

12. The method of claim 11, wherein the coating composition comprises at least about 40% wax emulsion solids by weight.

13. The method of claim 12, wherein the coating composition comprises about 40% by weight wax solids to about 80% by weight wax solids.

14. The method of claim 10, wherein the polymer resin comprises a latex resin.

15. The method of claim 14, wherein the latex resin comprises an acrylic resin, styrene-butadiene rubber resin, acetate resin, or mixture thereof.

16. The method of claim 10, wherein the polymer resin comprises a vinyl latex resin.

17. The method of claim 1, wherein the first part further comprises a filler.

18. The method of claim 17, wherein the filler comprises clay, glass beads, calcium carbonate, talc, silicas, organic fillers, or mixtures thereof.

19. The method of claim 1, wherein the sealing system is applied on a major surface of the substrate.

20. The method of claim 1, wherein the engineered wood substrate comprises fiberboard, or a laminated veneer lumber product.

21. The method of claim 1, wherein the engineered wood substrate comprises oriented strand board.

22. The method of claim 1, wherein the coating composition provides a dry film thickness of about 0.0025 to about 0.025 cm.

23. The method of claim 22, wherein the coating composition provides a dry film thickness of about 0.0051 to about 0.0203 cm.

24. The method of claim 23, wherein the coating composition provides a dry film thickness of about 0.0051 to 0.015 cm.

25. The method of claim 1, wherein the at least one surface of the substrate is an edge.

26. The method of claim 1, further comprising applying multiple layers of the aqueous coating composition.

27. The method of claim 1, further comprising applying layers of more than one aqueous coating composition.

28. The method of claim 25, wherein the sealing system is applied on all edges of the substrate.

* * * * *